US007938227B2

(12) United States Patent
Scheetz

(10) Patent No.: US 7,938,227 B2
(45) Date of Patent: May 10, 2011

(54) VARIABLE RESONATION CHAMBER VALVE

(75) Inventor: Derek R. Scheetz, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/574,388

(22) Filed: Oct. 6, 2009

(65) Prior Publication Data

US 2011/0079463 A1 Apr. 7, 2011

(51) Int. Cl.
*F01N 1/00* (2006.01)

(52) U.S. Cl. ... 181/254; 181/237; 181/212; 123/184.53; 123/184.57

(58) Field of Classification Search ..... 181/237, 181/254, 212; 123/184.53, 184.54, 184.55, 123/184.56, 184.57
See application file for complete search history.

(56) References Cited

U.S. PATENT DOCUMENTS

| | | | | |
|---|---|---|---|---|
| 4,539,947 | A * | 9/1985 | Sawada et al. | 123/184.57 |
| 5,283,398 | A | 2/1994 | Kotera et al. | |
| 6,173,808 | B1 * | 1/2001 | Maeda et al. | 181/254 |
| 6,508,331 | B1 | 1/2003 | Stuart | |
| 7,255,197 | B2 * | 8/2007 | Horiko | 181/250 |
| 7,320,378 | B2 | 1/2008 | Inaoka et al. | |
| 7,334,663 | B2 | 2/2008 | Nakayama et al. | |
| 7,337,877 | B2 | 3/2008 | Goenka et al. | |
| 7,506,723 | B2 * | 3/2009 | Hoerr et al. | 181/250 |
| 7,527,126 | B2 * | 5/2009 | Kuroda et al. | 181/254 |
| 7,610,993 | B2 * | 11/2009 | Sullivan | 181/268 |
| 2002/0033303 | A1 * | 3/2002 | Nagai et al. | 181/237 |
| 2008/0023264 | A1 * | 1/2008 | Pacini et al. | 181/237 |

* cited by examiner

*Primary Examiner* — Elvin G Enad
*Assistant Examiner* — Forrest M Phillips
(74) *Attorney, Agent, or Firm* — Rankin Hill & Clark LLP

(57) ABSTRACT

A variable resonation chamber valve includes an outer valve seat and a rotatable plunger. The outer valve seat defines an inlet opening into an associated resonation chamber. The rotatable plunger is movable into the inlet opening of the valve seat for varying a tuner area of the inlet opening.

20 Claims, 7 Drawing Sheets

VARIABLE RESONATION CHAMBER VALVE

BACKGROUND

The present disclosure generally relates to a resonation chamber for frequency attenuation in vehicles, and more particularly relates to a variable resonation chamber valve for controlling flow into a resonation chamber. In one application, the variable resonation chamber valve can be deployed in a vehicle exhaust system, particularly within the vehicle's silencer for example, though it is also amenable to other applications.

Resonator type silencers for vehicles are known where a resonance frequency is variable to attenuate noise generated from an internal combustion engine. One known resonator type silencer includes a resonation or tuning chamber that has an adjustable volume. In a known configuration, this adjustable volume silencer employs a variable tuner pipe sliding mechanism which adjusts the volume of the chamber and thereby provides variable resonation. A problem with this type of variable resonation silencer is that its moving components contact one another resulting in increased wear in friction concerns.

Also known are a variety of resonator type silencers that had been used in intake system and exhaust systems of vehicle internal combustion engines. These silencers are usually arranged to attenuate noise which is generated by the engine at a predetermined frequency under a resonance effect. That is, these types of silencers attenuate noise at a given frequency and are not adjustable. A drawback of such silencers is that they cannot handle intake or exhaust system noise where the frequency varies throughout a wide engine operating range.

BRIEF DESCRIPTION

According to one aspect, a variable resonation chamber valve includes a valve seat defining an inlet opening into an associated resonation chamber. A rotatable plunger is movable into the inlet opening of the valve seat for varying a tuner area of the inlet opening.

According to another aspect, a variable tuner valve includes an outer valve body forming an inlet opening into a resonation chamber. The inlet opening is in fluid communication with exhaust from an internal combustion engine. A rotatably supported valve plunger is selectively received within the outer valve body and the inlet opening to vary tuning through the inlet opening into the resonation chamber.

According to still another aspect, an adjustable exhaust silencer includes a silencer body having an intake port and an exhaust port. A separator is disposed in the silencer body to divide the silencer body into an expansion chamber and a resonation chamber. Each of the intake port and the exhaust port is in direct fluid communication with the expansion chamber. An outer valve seat is disposed in the separator and defines an inlet opening into the resonation chamber for direct fluid communication from the expansion chamber. A rotatable valve body in selectively received at a polarity of angular positions within the inlet opening for varying frequency attenuation by the resonation chamber.

DETAILED DESCRIPTION

Figure 1:
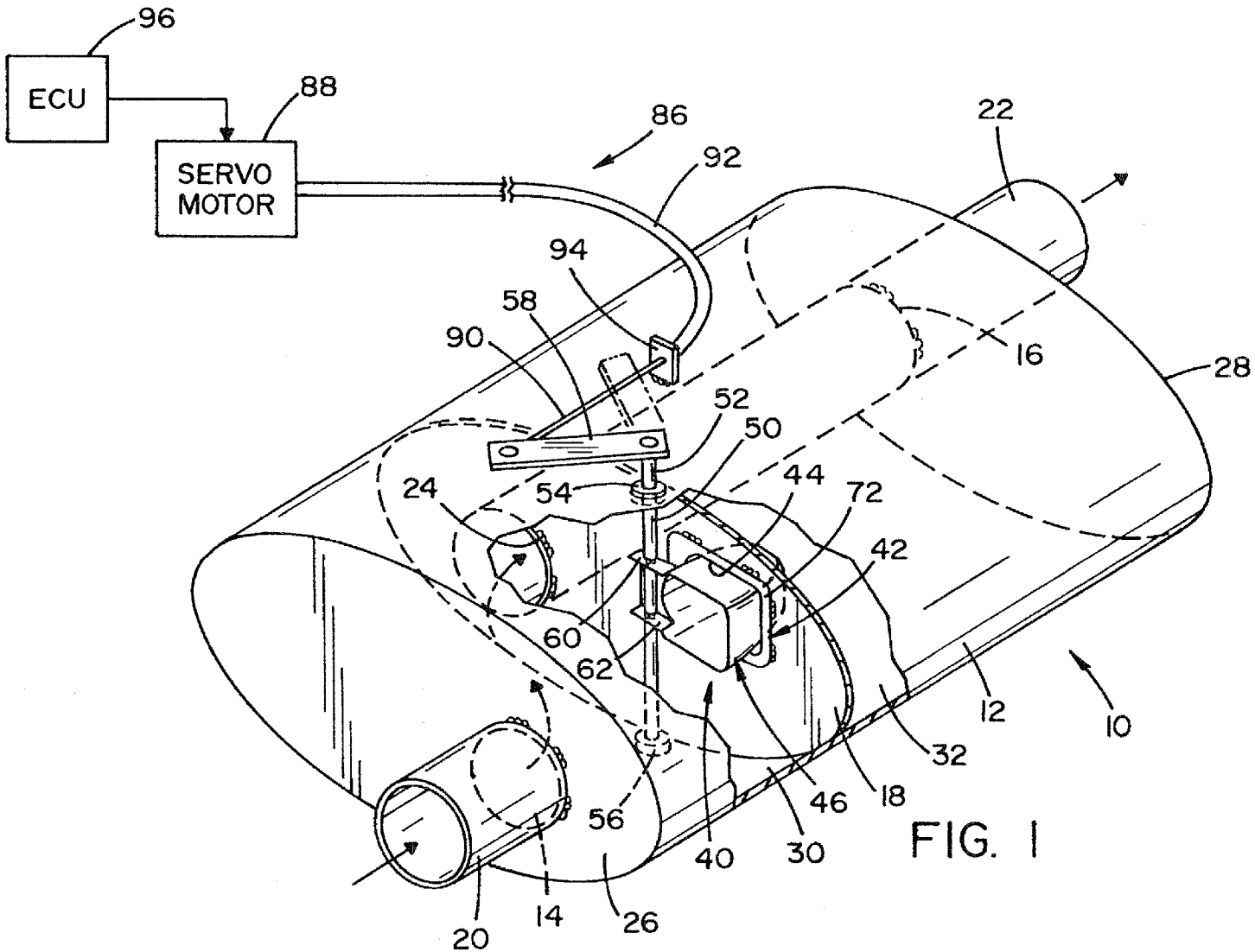
FIG. 1 is a perspective view of an adjustable exhaust silencer shown with a portion removed to illustrate a variable resonation chamber valve disposed within the silencer.
Figure 2:
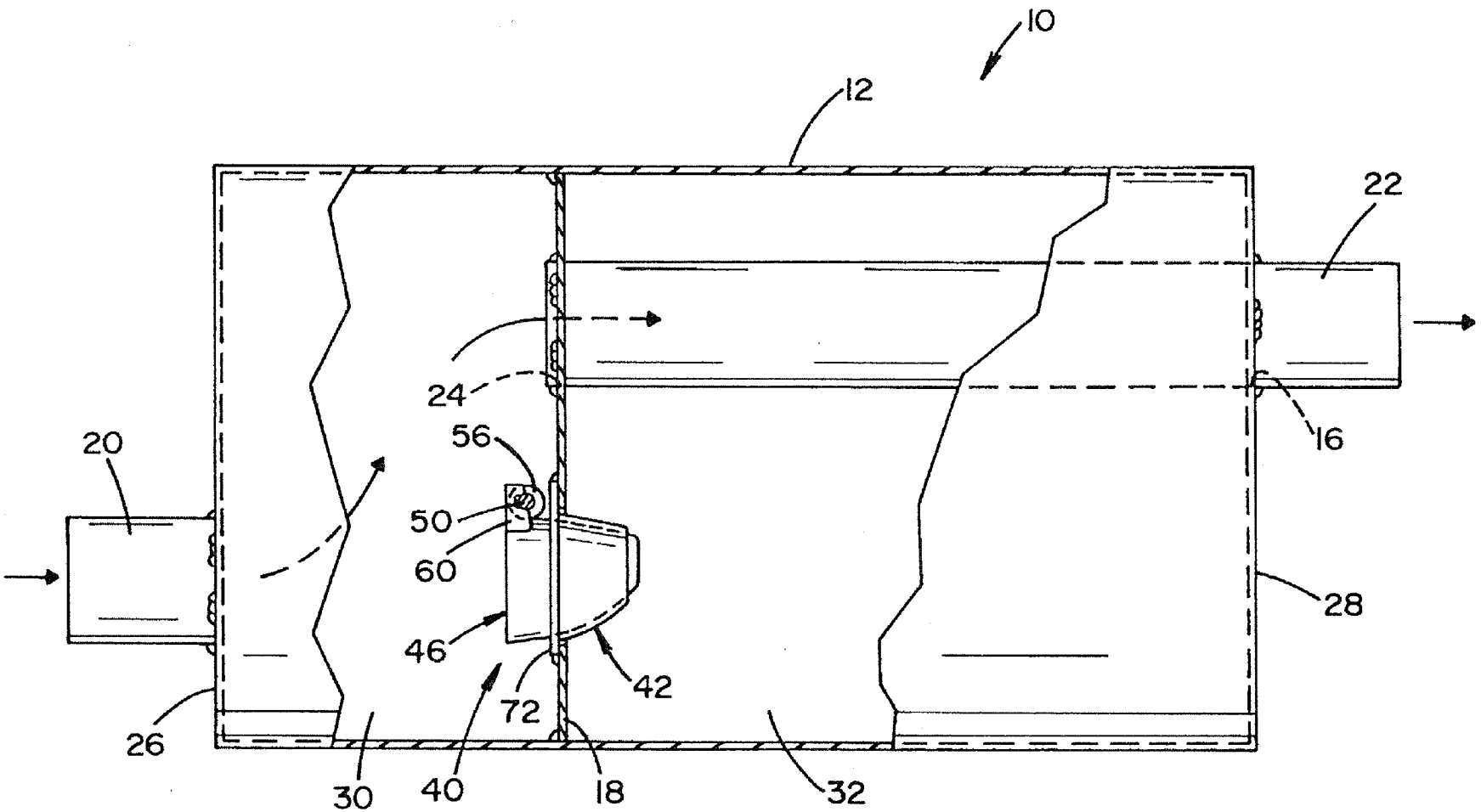
FIG. 2 is a plan view, shown partially in cross section, of the adjustable exhaust silencer.
Figure 3:
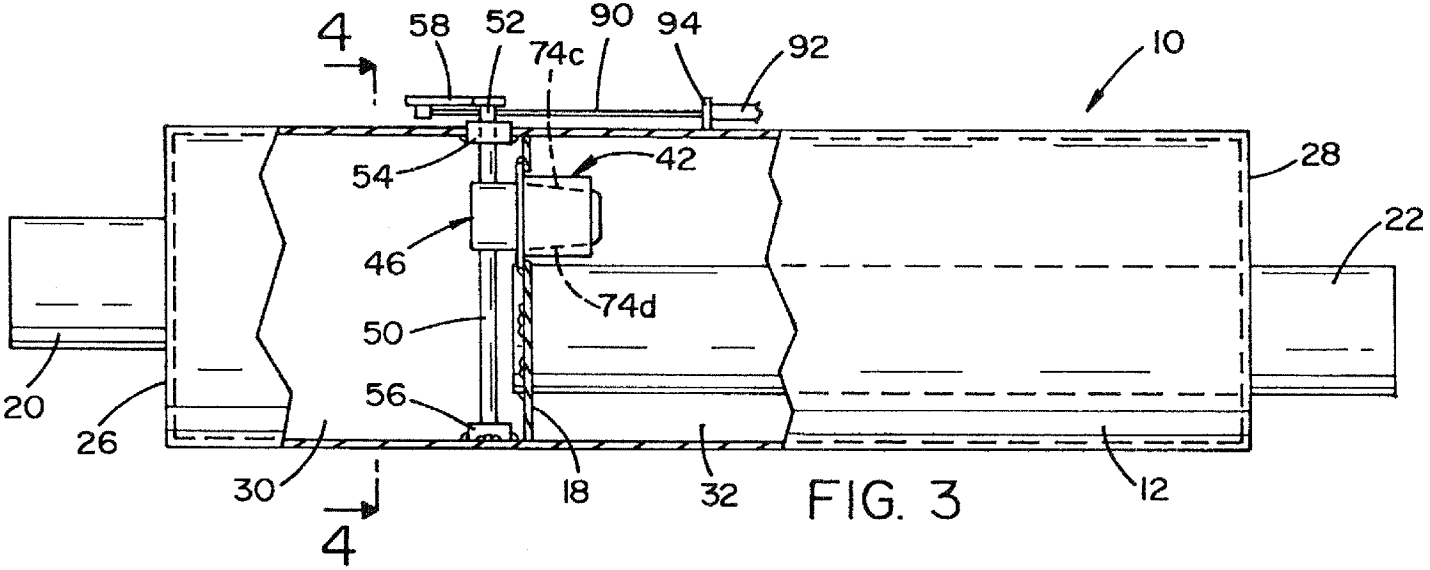
FIG. 3 is a side elevation view, shown partially in cross section, of the adjustable exhaust silencer.
Figure 4:
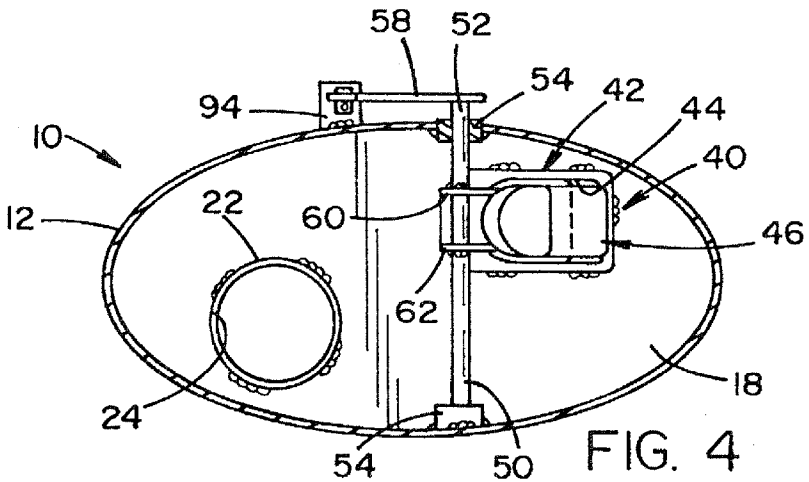
FIG. 4 is a cross sectional view of the adjustable exhaust silencer taken along the line 4-4 of FIG. 3.

Referring now to the drawings, wherein the showings are for purposes of illustrating one or more exemplary embodiments and not for purposes of limiting same, an adjustable exhaust silencer is shown and generally indicated by reference numeral 10. The adjustable exhaust silencer 10 includes a silencer body 12 having an intake port 14 and an exhaust port 16 defined through a pair of end plates 26,28. The silencer body 12 can particularly be formed of a wrapped sheath of material, such as steel. In an exemplary embodiment, a sheath of material, which can be a double-layer sheath, is wrapped into an oval shape and spot-welded together. A separator 18 can be press-fit, welded or otherwise secured in position within the silencer body 12. An intake pipe section 20 can be welded in position in registry with the intake port 14. An exhaust pipe section 22 can be inserted through the exhaust port 16 and welded to the separator 18 such that the exhaust pipe section 20 is in registry with separator port 24 defined through the separator 18.

The end plates 26, 28 can be secured to opposite ends of the silencer body 12. The end plate 26 defines the intake port 14 and has the intake pipe section 20 secured thereto, such as by welding. The end plate 28 defines the exhaust port 16 and has the exhaust pipe section 22 received therethrough. The separator 18 is disposed within the silencer body 12 to divide the silencer body 12 into an expansion chamber 30 and a resonation chamber 32. As shown, each of the intake port 14 and the exhaust port 16 is in direct fluid communication with the expansion chamber 30. In particular, the intake port 14 fluidly connects the intake pipe section 20 to the expansion chamber 30 and the exhaust pipe section 22 fluidly connects the exhaust port 16 to the expansion chamber 30 via the separator port 24 defined through the separator 18. The expansion chamber 30 is particularly defined between the end plate 26 and the separator 18, whereas the resonation chamber 32 is particularly defined between the end plate 28 and the separator 18.

Operation of the silencer 10 can occur as is known and understood by those skilled of the art. In particular, when the silencer 10 is employed in a vehicle exhaust system, exhaust from an internal combustion engine is directed into the silencer 10 via the intake pipe section 20 and the intake port 14. The exhaust enters the expansion chamber 30, which is expanded in volume relative to the intake pipe section 20. Exhaust can then flow from the expansion chamber 30 through the separator port 24 and into the exhaust pipe section 22 which directs the exhaust out of the silencer 10 through the exhaust port 16.

Disposed within the silencer 10 is a variable resonation chamber valve 40, also referred to herein as a variable tuner valve. The variable resonation chamber valve 40 is shown and described herein for use within a vehicle exhaust system, particularly within the silencer 10. However, it is to be appreciated and understood by those skilled in the art that the variable resonation chamber valve 40 could be used in other applications and is not limited to use within a vehicle exhaust system or within a silencer. For example, the variable resonation chamber valve 40 could be used in conjunction with an engine intake system, used in the vehicle's exhaust system outside the silencer, etc.

In the illustrated embodiment, the variable resonation chamber valve 40 includes an outer valve body or seat 42 disposed in the separator 18. The outer valve seat 42 defines or forms an inlet opening 44 into the resonation chamber 32 for direct fluid communication from the expansion chamber 30. In particular, the inlet opening 44 is in fluid communication through the expansion chamber 30 with exhaust expelled from an internal combustion engine (not shown) arranged upstream of the silencer 10 via the intake pipe section 20 and the intake port 14. In particular, the outer valve seat 42 can be welded to the separator 18 or otherwise connected such that the inlet opening 44 is defined through the separator 18 and facilitates fluid communication between the expansion chamber 30 and the resonation chamber 32.

The variable resonation chamber valve 40 further includes a rotatable valve body or plunger 46 movable into the inlet opening 44 of the outer valve seat 42 for varying a tuner area of the inlet opening 44. The rotatable valve plunger 46, which is rotatably supported as will be described in further detail below, is selectively received within the outer valve seat 42 and the inlet opening 44 thereof to vary tuning through the inlet opening 44 into the resonation chamber 32. In particular, the rotatable valve plunger 46 is selectively received at a plurality of angular positions within the inlet opening 44 for varying frequency attenuation by the resonation chamber 32. Accordingly, tuning through the inlet opening 44 is varied by rotating the rotatable valve plunger 46 to various angular positions relative to the outer valve body 42. As will be described in more detail below, the tuner area of the inlet opening 44 can be defined between the outer valve seat 42 and the rotatable valve plunger 46 (i.e., when the rotatable valve plunger 46 is received within the outer valve seat 42), but without contact between the outer valve seat 42 and the rotatable valve plunger 46, or can be defined by the entire inlet opening 44 (i.e., when the rotatable valve plunger 46 is removed from the outer valve seat 42 and the inlet opening 44).

In the illustrated embodiment, the rotatable valve plunger 46 is fixedly secured to a rotatable shaft 50, which has one exposed end 52 protruding outside the silencer body 12. Accordingly, the shaft 50 can be rotated by turning the exposed end 52, which in turn rotates the rotatable valve plunger 46 relative to the outer valve seat 42. As shown, bearings 54, 56 can be employed adjacent the silencer body 12 for rotatably mounting the shaft 50 with the silencer 10. In the illustrated embodiment, the exposed end 52 of the rotatable shaft 50 is fixed to arm or extension member 58 which enables linear motion to be employed for rotating the shaft 50 as will be described in more detail below. In the illustrated embodiment, the rotatable valve plunger 46 includes mounting arms 60, 62 which fixedly secure the rotatable valve plunger 46 to the shaft 50 for co-rotation therewith.

Also in the illustrated arrangement, the rotatable valve seat 42 and the rotatable valve plunger 46 have cooperating tapering surfaces that allow the tuner area to vary as the rotatable valve plunger 46 is rotated to varying angular positions relative to the rotatable valve seat 42. In particular, in the illustrated embodiment, the outer valve seat 42 includes a circumferentially continuous wall 70 that defines the inlet opening 44. The outer valve seat 42 further includes a mounting flange or portion 72 configured to allow the outer valve seat 42 to be mounted against the separator 18.

Figure 5:
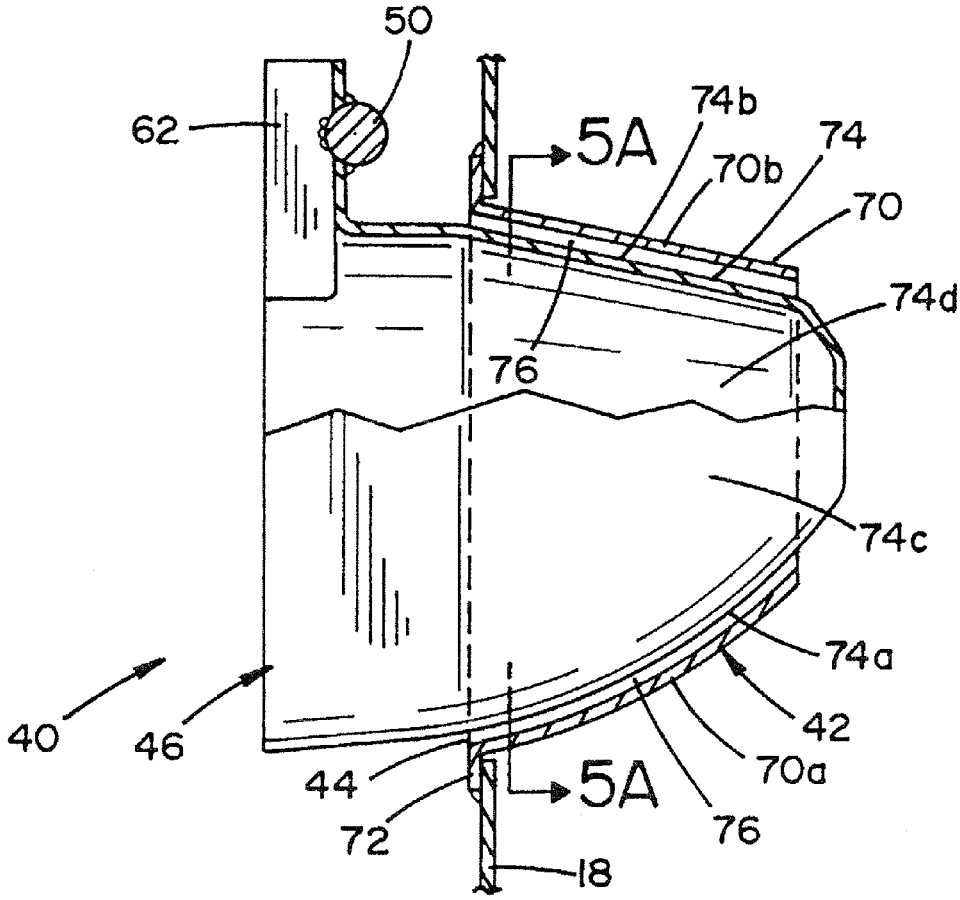
FIG. 5 is an enlarged plan view, partially in cross section, of the variable resonation chamber valve showing a valve plunger fully received in a valve seat.
Figure 5A:
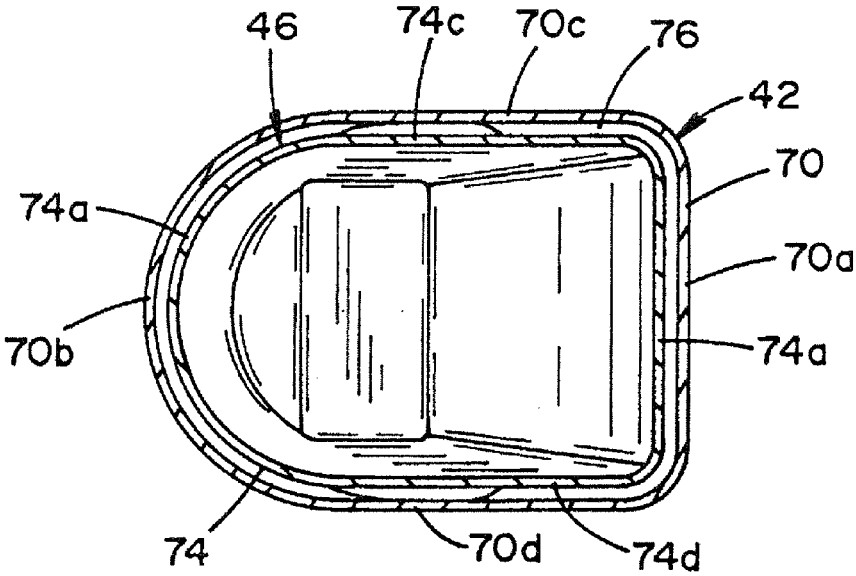
FIG. 5A is a cross sectional view of the variable resonation chamber valve taken along the line 5A-5A of FIG. 5.

With reference to FIGS. 5 and 5A, the circumferentially continuous wall 70 includes a first wall portion 70*a*, a second wall portion 70*b*, a third wall portion 70*c*, and a fourth wall portion 70*d*. The first wall portion 70*a* is generally parallel to the rotatable shaft 50 in FIG. 5A and is curved or forms a radius of curvature about the rotatable shaft 50 in FIG. 5. The second wall portion 70*b* is curved in FIG. 5A and is tapered, generally linearly, in FIG. 5. The third and fourth wall portions 70*c*, 70*d* are generally parallel to one another and connect the first and second wall portions 70*a*, 70*b*. By this configuration, the outer valve seat 42 includes wall portions 70*a*, 70*b* (i.e., converging wall portions) that converge toward one another in forming the inlet opening 42.

The rotatable valve plunger 46 also includes a circumferentially continuous wall 74 that is secured, for example integrally, to the mounting arms 60, 62. The circumferentially continuous wall 74 can include first wall portion 74*a*, second wall portion 74*b*, third wall portion 74*c*, and fourth wall portion 74*d*. The first wall portion 74*a* is generally parallel to the rotatable shaft in FIG. 5 and is generally curved or forms a radius of curvature about the rotatable shaft 50 in FIG. 5A. The second wall portion 74*b* is curved in FIG. 5A and is tapered, generally linearly in the illustrated embodiment, in FIG. 5. The wall portions 74*c* and 74*d* connect the wall portions 74*a*, 74*b* and can taper or converge toward one another in a direction parallel to a longitudinal axis of the silencer 10. By this arrangement, the rotatable valve plunger 46 includes the wall portions 74*a*, 74*b*, 74*c*, 74*d* that are all converging toward one another.

The converging wall portions 74*a*, 74*b* of the rotatable valve plunger 46 have a matching configuration relative to the converging wall portions 70*a*,70*b* of the outer valve seat 42. More specifically, the degree of taper and radius of curvature of the wall portions 70*a* and 74*a* are generally matching and complementary. Likewise, the degree of taper of the wall portions 70*b* and 74*b* are generally matching and complementary. Accordingly, the wall portions 70*a*, 70*b* and 74*a*, include complementary or cooperating tapering surfaces with respective matching curved portions. When the rotatable valve plunger 46 is received in the inlet opening 44, the converging wall portions 70*a*, 70*b* and 74*a*, 74*b*, together with the wall portions 70*c*, 70*d* and 74*c*, 74*d*, form an angular passage 76 through the inlet opening 44 (i.e., when the rotatable valve plunger 42 is received in the outer valve seat 46). This angular passage 76 becomes the tuner area of the variable resonation chamber valve 40. A size of the angular passage 76 can be varied based on a degree to which the rotatable valve plunger 46 is received in the outer valve seat 42.

Figure 7:
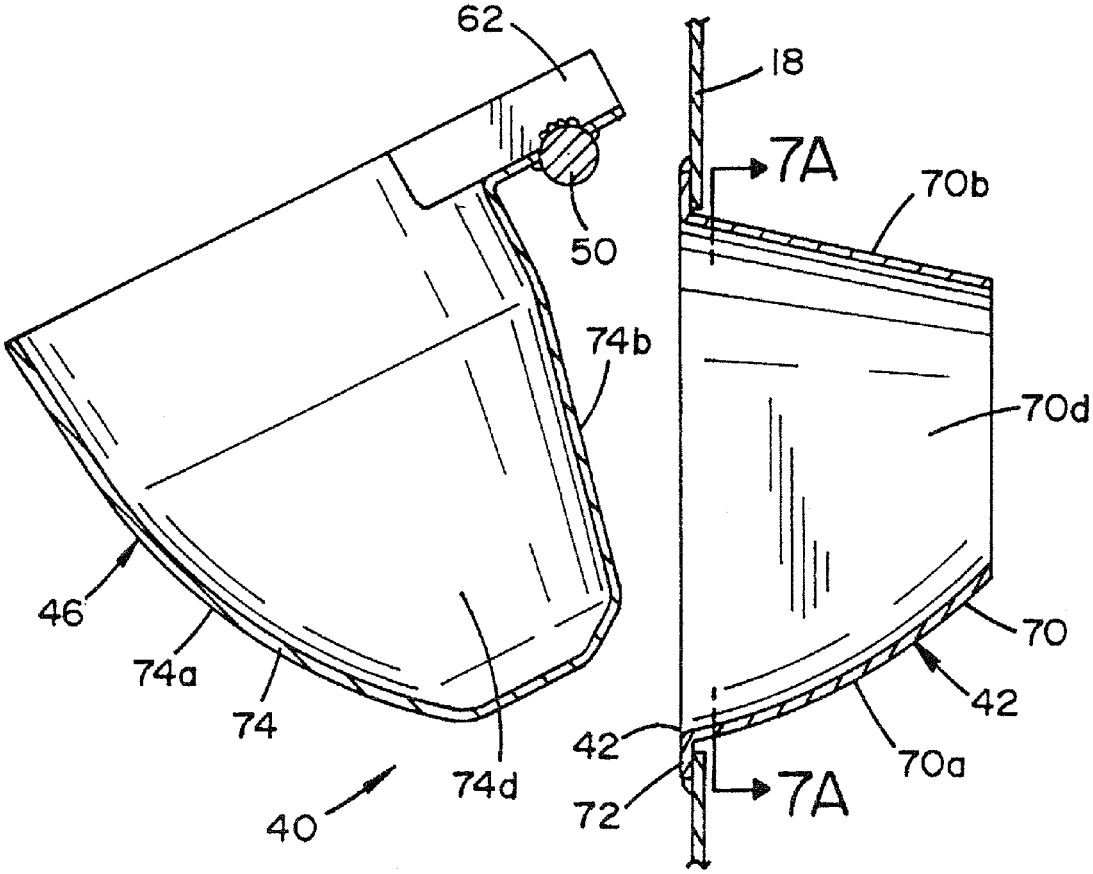
FIG. 7 is still another plan view, partially in cross section, of the variable resonation chamber valve shown with the valve plunger fully removed from the valve seat.
Figure 7A:
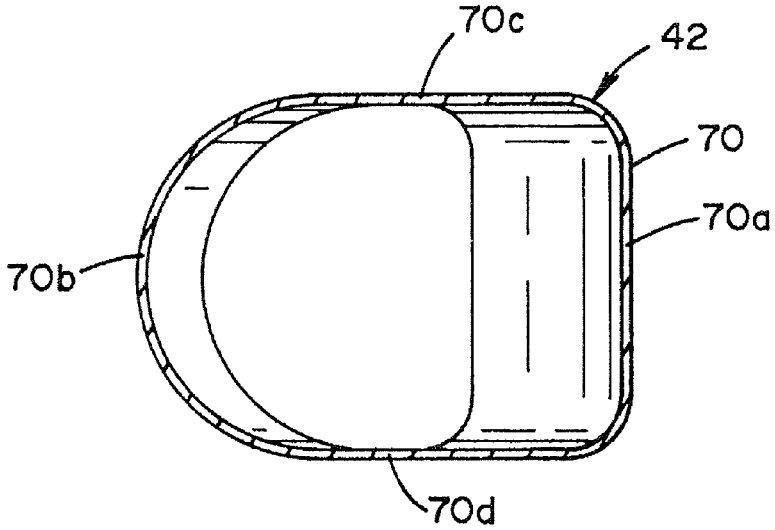
FIG. 7A is a cross sectional view of the variable resonation chamber valve taken along the line 7A-7A of FIG. 7.

In operation, the rotatable valve plunger 46 is movable between a first minimum position (shown in FIGS. 5 and 5A) wherein the rotatable valve plunger 46 is received in the inlet opening 44 to reduce the tuner area 76 to a minimum area for low frequency attenuation and a second maximum position (shown in FIGS. 7 and 7A) wherein the rotatable valve plunger 46 is removed or withdrawn from the inlet opening 44 to increase the tuner area to a maximum area for high frequency attenuation (i.e., the tuner area equals the size of the inlet opening 44). Accordingly, the rotatable valve plunger 46 is movable to the first position wherein the rotatable valve plunger 46 is fully or entirely inserted in the inlet opening 44 to minimize the size of the angular passage 76 and the second position wherein the rotatable valve plunger 46 is fully or entirely removed from the inlet opening 44 to maximize flow to the inlet opening 44, which maximizes frequency attenuation by the resonation chamber 32.

Figure 6:
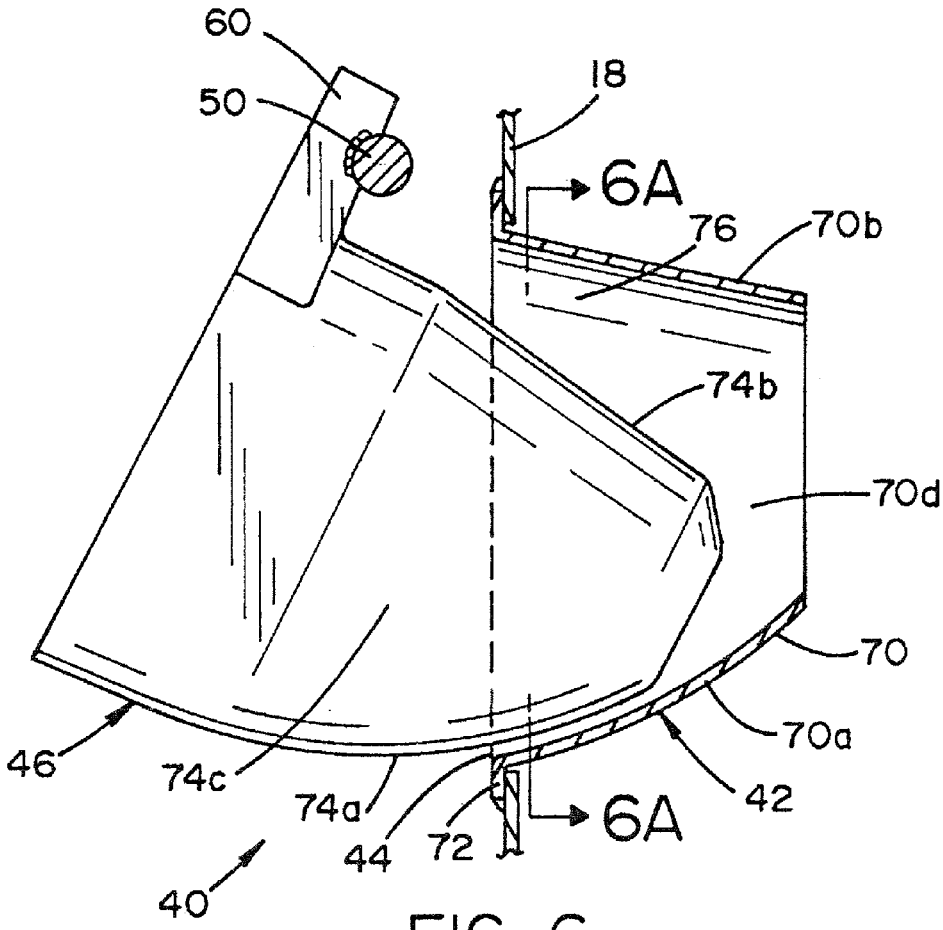
FIG. 6 is another plan view, partially in cross section, of the variable resonation chamber valve showing the valve plunger partially inserted (or removed) from the valve seat.
Figure 6A:
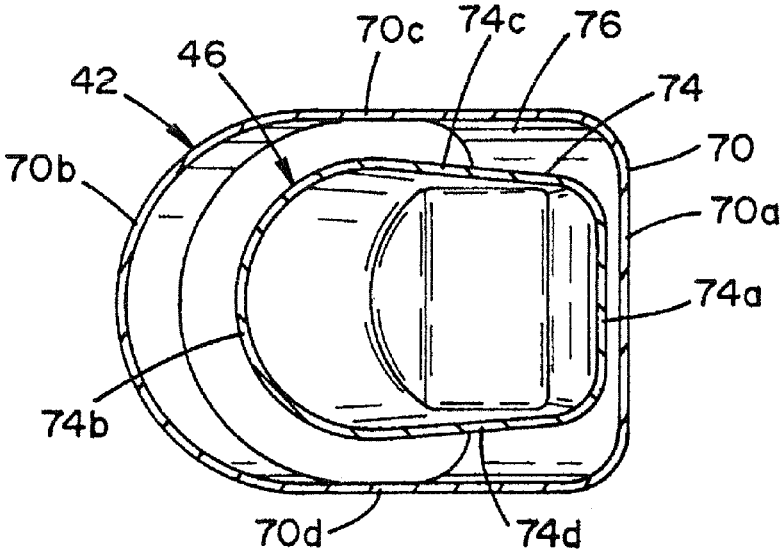
FIG. 6A is a cross sectional view of the variable resonation chamber valve taken along the line 6A-6A of FIG. 6.

The rotatable valve plunger 46 is also movable to intermediate positions between the first and second positions wherein the rotatable valve plunger 46 is partially inserted in the inlet opening 44 to variably adjust the size of the angular passage 76. For example, with reference to FIGS. 6 and 6A, the rotatable valve plunger 46 is movable to the illustrated intermediate position, which is between the first and second positions, wherein the rotatable valve plunger 46 is partially received in the inlet opening 44 to adjust a tuner area 76 to an intermediate area for mid level frequency attenuation. It is to be appreciated by the skill in the art that the rotatable valve plunger 46 remains spaced apart from the outer valve seat 42 in all of its positions, including the first position of FIGS. 5 and 5A, the second position of FIGS. 7 and 7A and any intermediate position (e.g., the position illustrated in FIGS. 6 and 6A) between the first and second positions, which reduces at least one of friction, wear, and corrosion. In the illustrated variable resonation chamber valve 40, the contactless arrangement between the rotatable valve plunger 46 and the outer valve seat 42 advantageously reduces each of friction, wear, and corrosion concerns within the variable resonation chamber valve 40. In particular, the rotatable valve plunger is angularly spaced apart from the outer valve seat 42 when it is received in the inlet opening 44 for contactless varying of a size of the inlet opening 44.

With reference back to FIG. 1, the variable resonation chamber valve 40 can additionally include a remote actuation device 86 for rotating the rotatable valve plunger 46. In the illustrated embodiment, the remote actuation device 86 includes an actuator, for example servo motor 88, remotely positioned relative to the rotatable valve plunger 46 and connected thereto for selectively rotating the rotatable valve plunger 46 relative to the outer valve seat 42. As shown, the actuator or motor 88 can be connected to the rotatable valve plunger 46 by a cable link 90. As is known and understood by those skilled in the art, the cable link 90 can be housed in a sheath 92 with one end connected to a distal end of the arm 58 and an opposite end connected to the servo motor 88. As shown, one end of the sheath adjacent the arm 58 can be secured to the silencer body 12 by a mounting plate 94, though other arrangements of course can be employed. The servo motor 88 can be controlled by an electronic control unit (ECU) 96, which could be for example the main vehicle ECU. By way of example, the ECU 96 could direct operation of the motor 88 in a first direction to pull the cable 90 to rotate the rotatable plunger in a corresponding first direction (i.e., toward the second position of FIGS. 7 and 7A) and operation of the motor 88 in a second, opposite direction pays the cable 90 out of the sheath 92 to rotate the rotatable valve plunger 46 in a corresponding second, opposite direction (i.e., toward the first position of FIGS. 5 and 5A). Through the arm 58, linear movement of the cable 90 is translated into rotational movement of the rotatable valve plunger 46. When rotating the rotatable valve plunger 46, the motor 88 by direction from the ECU 96 can also stop at any time so as to hold the rotatable valve plunger 46 in any intermediate position between the first and second positions (e.g., the intermediate position illustrated in FIGS. 6 and 6A).

Figure 8:
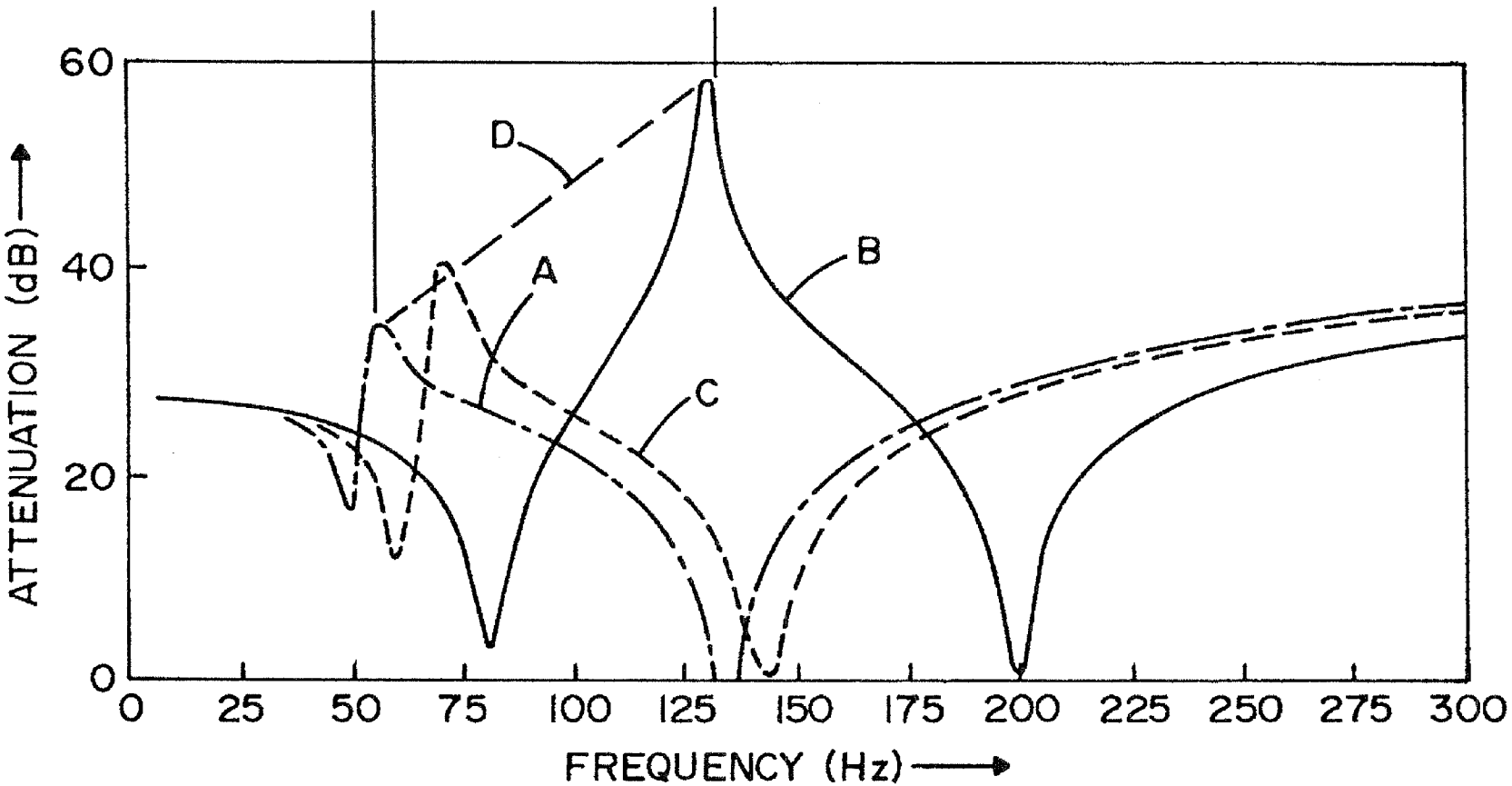
FIG. 8 is a diagram showing frequency versus attenuation and a variable attenuation range available through the variable resonation chamber valve.

With reference to FIG. 8, an exemplary frequency versus attenuation diagram is shown. The curve A illustrates frequency versus attenuation for when the rotator valve plunger 46 is fully inserted in the inlet opening 44. As already mentioned, this tends to attenuate lower frequencies, such as those around 50-75 Hz. The curve B illustrates frequency versus attenuation for the variable resonation chamber valve 40 when the rotatable valve plunger 46 is in the second fully removed position of FIGS. 7 and 7A. As shown, this tends to attenuate high frequencies, such as those around 130 Hz. Another frequency versus attenuation curve C is shown corresponding to the intermediate position of FIGS. 6 and 6A. This particular intermediate position attenuates mid level frequencies, such as those around 65 Hz. As represented by the dashed line D, variably frequency attenuation is achievable by the variable resonation chamber valve 40 between the low frequency attenuation position and the high frequency attenuation position (i.e., between about 50 Hz and 130 Hz). That is, the rotatable valve plunger 46 can be rotated to any position between the first position and the second position to adjust frequency attenuation to any desired point along the line D. Accordingly, exhaust attenuation is infinitely variable within the range represented by the line D.

Advantageously, the variable resonation chamber valve 40 can reduce overall silencer packaging volume and weight. In addition, exhaust sounds can be programmed to match the concept of various vehicles (e.g., a sport vehicle, a luxury vehicle, etc.) with no hardware changes required. Also advantageously, unlike traditional valves that restrict exhaust flow to increase attenuation, the arrangement of the variable resonation chamber valve 40 within the silencer 10 does not restrict exhaust flow, thereby potentially increasing vehicle power and/or fuel economy.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A variable resonation chamber valve for a vehicle, comprising:

a valve seat defining an inlet opening into an associated resonation chamber, said valve seat comprising converging wall portions that form said inlet opening; and a rotatable plunger movable into said inlet opening of said valve seat for varying a tuner area of said inlet opening, said tuner area defined between said valve seat and said rotatable plunger without contact between said valve seat and said rotatable plunger, said rotatable plunger comprising converging wall portions having a matching configuration as said converging wall portions of said valve seat, said converging wall portions of said valve seat and said converging wall portions of said rotatable plunger forming an annular passage through said inlet opening when said rotatable plunger is received in said inlet opening, a size of said annular passage varying based on a degree to which said rotatable plunger is received in said inlet opening.

2. The variable resonation chamber valve of claim 1 wherein said valve seat and said rotatable plunger have cooperating tapering surfaces that allow said tuner area to vary as said rotatable plunger is rotated to varying angular positions relative to said valve seat.

3. The variable resonation chamber valve of claim 2 wherein said cooperating tapering surfaces include respective matching curved portions on said valve seat and said rotatable plunger.

4. The variable resonation chamber valve of claim 1 wherein said rotatable plunger is movable between a first minimum position wherein said rotatable plunger is received in said inlet opening to reduce said tuner area to a minimum area for low frequency attenuation and a second maximum position wherein said rotatable plunger is removed from said inlet opening to increase said tuner area to a maximum area for high frequency attenuation.

5. The variable resonation chamber valve of claim 4 wherein said rotatable plunger is movable to an intermediate position between said first and second positions wherein said rotatable plunger is partially received in said inlet opening to adjust said tuner area to an intermediate area for midlevel frequency attenuation.

6. The variable resonation chamber valve of claim 4 wherein said rotatable plunger remains spaced apart from said valve seat in said first position, said second position and any position between said first and second positions for reducing at least one of friction, wear and corrosion.

7. The variable resonation chamber valve of claim 1 further including a remote actuation device for rotating said rotatable plunger, said remote actuation device includes an actuator remotely positioned relative to said rotatable plunger and connected thereto for selectively rotating said rotatable plunger relative to said valve seat.

8. The variable resonation chamber valve of claim 7 wherein said actuator is a motor that is connected to said rotatable plunger by a cable link, operation of said motor in a first direction pulls said cable to rotate said rotatable plunger in a corresponding first direction and operation of said motor in a second, opposite direction pays said cable to rotate said rotatable plunger in a corresponding second, opposite direction.

9. The variable resonation chamber valve of claim 1 wherein the associated resonation chamber is defined within a silencer of a vehicle exhaust system, said inlet opening defined through a separator received in said silencer between the associated resonation chamber and an associated expansion chamber upstream of the associated resonation chamber.

10. The variable resonation chamber valve of claim 9 wherein said rotatable plunger is disposed in said expansion chamber and the rotatable plunger is received within said inlet opening from the expansion chamber to the resonation chamber.

11. A variable tuner valve for a vehicle exhaust system, comprising:

an outer valve body forming an inlet opening into a resonation chamber, said inlet opening in fluid communication with exhaust from an internal combustion engine, said outer valve body comprising converging wall portions that form said inlet opening; and a rotatably supported valve plunger selectively received within said outer valve body and said inlet opening without contact between said outer valve body and said valve plunger to vary tuning through said inlet opening into said resonation chamber, said valve plunger comprising converging wall portions having a matching configuration as said converging wall portions of said outer valve body, said converging wall portions of said valve plunger and said converging wall portions of said outer valve body forming an annular passage through said inlet opening when said valve plunger is received in said outer valve body, a size of said annular passage varying based on a degree to which said valve plunger is received in said outer valve body.

12. The variable tuner valve of claim 11 wherein tuning through said inlet opening is varied by rotating said valve plunger to various angular positions relative to said valve body.

13. The variable turner valve of claim 11 wherein said valve plunger is disposed outside said resonation chamber.

14. The variable resonation chamber valve of claim 11 wherein said valve plunger is movable to a first position wherein said valve plunger is fully inserted in said inlet opening to minimize said size of said annular passage, a second position wherein said valve plunger is fully removed from said inlet opening to maximize flow through said inlet opening, and intermediate positions between said first and second positions wherein said valve plunger is partially inserted in said inlet opening to variably adjust said size of said annular passage.

15. The variable resonation chamber valve of claim 11 including a remote actuation device comprising a servo motor controlled by an ECU, said servo motor linked to said valve plunger through a cable for rotation thereof.

16. An adjustable exhaust silencer, comprising:

a silencer body including an intake port and an exhaust port;

a separator disposed in said silencer body to divide said silencer body into an expansion chamber and a resonation chamber, each of said intake port and said exhaust port in direct fluid communication with said expansion chamber;

an outer valve seat disposed in said separator and defining an inlet opening into said resonation chamber for direct fluid communication from said expansion chamber, said outer valve seat comprising converging wall portions that form said inlet opening; and a rotatable valve body selectively received at a plurality of angular positions within said inlet opening without contact between said outer valve seat and said valve body for varying frequency attenuation by said resonation chamber, said valve body comprising converging wall portions having a matching configuration as said converging wall portions of said outer valve seat, said converging wall portions of said valve body and said converging wall portions of said outer valve seat forming an annular passage through said inlet opening when said valve body is received in said inlet opening, a size of said annular passage varying based on a degree to which said valve body is received in said inlet opening.

17. The adjustable exhaust silencer of claim 16 wherein said rotatable valve body is entirely removable from said inlet opening for maximizing frequency attenuation by said resonation chamber.

18. The adjustable exhaust silencer of claim 16 wherein said rotatable valve body is annularly spaced apart from said outer valve seat when received in said inlet opening for contactless varying of a size of said inlet opening.

19. The adjustable exhaust silencer of claim 16 wherein said outer valve seat has a tapered and curved configuration and said rotatable valve body has a matching tapered and curved configuration.

20. The adjustable exhaust silencer of claim 16 wherein said valve body is disposed in the expansion chamber and said valve body is received within said inlet opening from the expansion chamber to said resonation chamber.

* * * * *